US006951181B1

(12) United States Patent
Lemke

(10) Patent No.: US 6,951,181 B1
(45) Date of Patent: Oct. 4, 2005

(54) PONTOON BOAT FENDER

(76) Inventor: Stuart H. Lemke, W1468 Longbasco La., Gleason, WI (US) 54435

( * ) Notice: Subject to any disclaimer, the term of this patent is extended or adjusted under 35 U.S.C. 154(b) by 0 days.

(21) Appl. No.: 11/029,769

(22) Filed: Jan. 5, 2005

Related U.S. Application Data

(60) Provisional application No. 60/534,601, filed on Jan. 6, 2004.

(51) Int. Cl.[7] ..... B63B 59/02
(52) U.S. Cl. ..... 114/219
(58) Field of Search ..... 114/219; 405/212–215

(56) References Cited

U.S. PATENT DOCUMENTS 5,697,316 A * 12/1997 Kinkead ..... 114/219
6,823,811 B1 * 11/2004 Drake ..... 114/219

FOREIGN PATENT DOCUMENTS

DE 3332733 A1 * 3/1985

* cited by examiner

*Primary Examiner*—Ed Swinehart
(74) *Attorney, Agent, or Firm*—Andrus, Sceales, Starke & Sawall, LLP

(57) ABSTRACT

A protective fender is provided for use on a pontoon boat having at least an upper support member and a lower support member. The fender includes an elongated body formed from protective material. A first fastening structure is connected to the body, engageable with the lower support member and moveable between a plurality of positions along a length of the body. A second fastening structure is connected to the body, engageable with the upper support member and adjustable to vary the position of the second fastening structure relative to the body.

8 Claims, 2 Drawing Sheets

PONTOON BOAT FENDER

CROSS-REFERENCE TO RELATED APPLICATION

This application relates to and claims priority from U.S. Provisional Application Ser. No. 60/534,601 filed Jan. 6, 2004.

FIELD OF THE INVENTION

The present invention relates to protective fenders for floating structures and more particularly to protective fenders for use on a pontoon boat.

BACKGROUND OF THE INVENTION

Traditional protective fenders to be utilized with a pontoon boat hang off a rail of a pontoon boat and are susceptible to excessive swinging and pendulum-like movement and are not aesthetically pleasing.

It is desirable to provide a fender with a tight top and bottom adjustable attachment so that the fender remains in place and eliminates any movement or loosening of the fender.

SUMMARY OF THE INVENTION

It is a general object of the present invention to provide a protective fender especially designed to protect pontoon boats from damage due to contact with other objects such as boats, rafts, piers and docks.

In one aspect of the invention, a protective fender is provided for use on a pontoon boat of the type having at least an upper support member and a lower support member. The fender includes an elongated body formed from protective material. A first fastening structure is connected to the body, engageable with the lower support member and is moveable between a plurality of positions along a length of the body. A second fastening structure is connected to the body, engageable with the upper support member, and is adjustable to vary the position of the second fastening structure relative to the body. The first fastening structure comprises a U-shaped member with a first leg engageable with the lower support member and a second leg engageable with the body. The U-shaped member includes a base portion connecting the first and second legs, and the first leg being releasably engageable with the base portion along a plurality of positions whereby the distance between the first and second legs may be varied. The base portion includes a plurality of channels engageable with the first leg. The first fastening structure includes a horizontal shaft attached to the second leg of the U-shaped member. The body includes a front face, a pair of outwardly and rearwardly flaring sidewalls, and a rear panel formed with a series of receiver grooves for frictionally retaining the horizontal shaft therein. The rear panel has retainer structure for removably attaching a foam block structure thereto between the first fastening structure and the second fastening structure. An elastic retainer cord has one end attached to the body and an opposite end connected to the first fastening structure. The second fastening structure includes a J-shaped member engageable with the upper support member, and an adjustable strap having one end attached to the J-shaped member and another end attached to the body.

In another aspect of the invention, a protective fender is provided for use on a pontoon boat having at least an upper horizontal support member and a lower horizontal support member. The fender includes an elongated body formed from protective material. A lower fastening hook structure is connected to the body, engageable with the lower horizontal support member and moveable between a plurality of vertically disposed positions along a length of the body. The lower fastening hook structure has a leg portion adjustable according to a depth of the lower horizontal support member. An upper fastening hook structure is connected to the body and includes a retaining hook engageable with the upper horizontal support member and an adjustable strap having one end attached to the retaining hook and an opposite end secured to the body to vary the position of the retaining hook relative to the body.

Various other objects, features and advantages of the invention will be made apparent from the following description taken together with the drawings.

BRIEF DESCRIPTION OF THE SEVERAL VIEWS OF THE DRAWINGS

The drawings illustrate the best mode presently contemplated of carrying out the invention.

In the drawings.

DETAILED DESCRIPTION OF THE INVENTION

Figure 1:
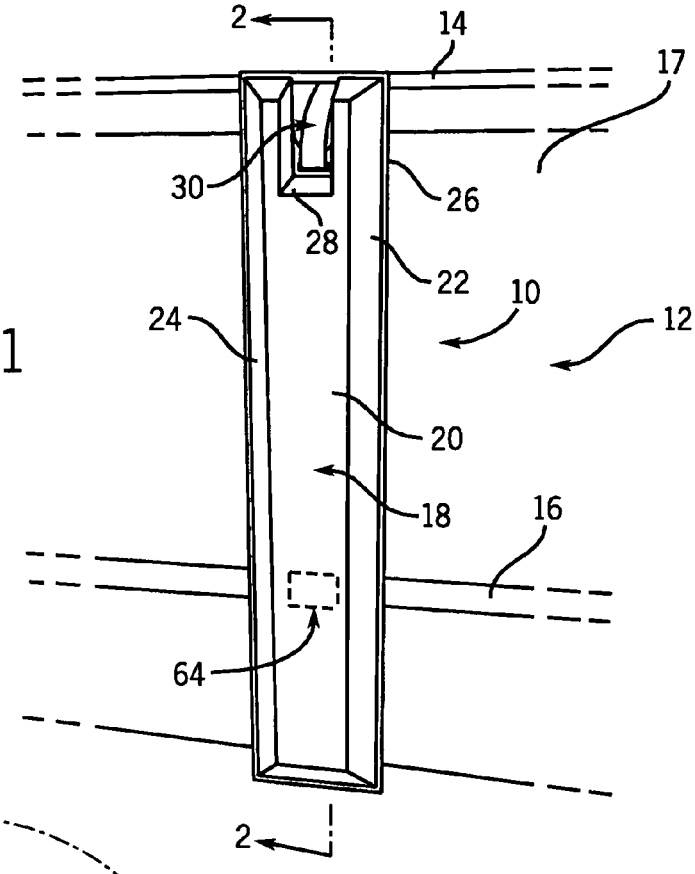
FIG. 1 is a perspective view of a protective fender installed on a pontoon boat in accordance with the present invention.

Referring now to FIG. 1, thereshown is a protective fender 10 for use with a pontoon boat 12 having at least an upper horizontal rail or support member 14 and a lower horizontal rail or support member 16 running along the side panel 17 of the boat 12. The fender 10 is formed with an elongated body 18 preferably molded from a material such as polyvinyl chloride (PVC) or any other suitable material having resilient, waterproof characteristics. Typically, the fender 10 has a width of about six inches, a length of either 24 inches or 36 inches, and a depth ranging from 3 inches to about 4 inches at its top end. The fender 10 includes a generally planar front face 20 with sidewalls 22, 24 that flare outwardly and rearwardly to a rear panel 26. In the molding process, the upper portion of the body 18 is provided with a recess 28 for accessing an upper fastening hook structure 30 used to adjustably attach the body 18 to the upper horizontal support member 14 of the boat 12.

Figure 3:
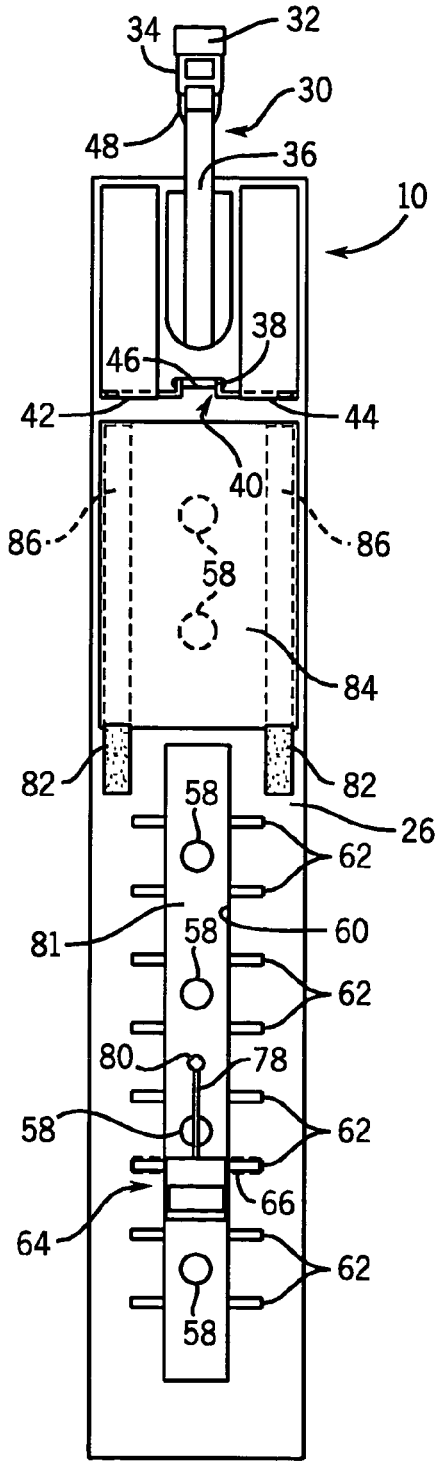
FIG. 3 is a plan view of the boat-facing side of the fender.
Figure 2:
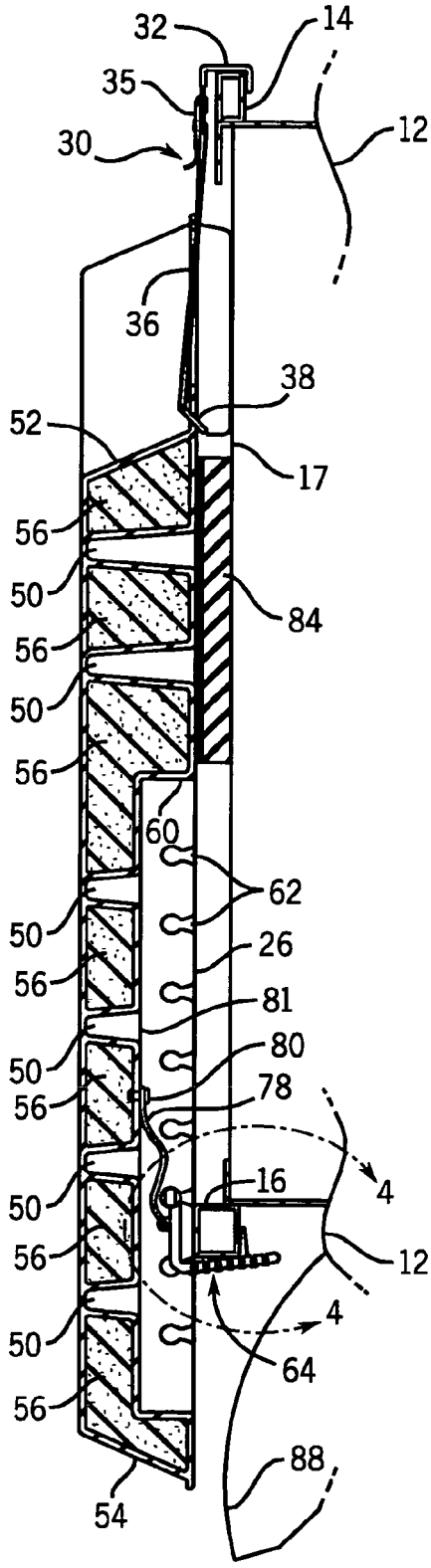
FIG. 2 is a cross-sectional view taken on line 2—2 of FIG. 1.

As seen in FIGS. 2 and 3, the upper fastening hook structure 30 includes an aluminum, J-shaped upper hook 32 having a rigid buckle portion 34 which receives a looped end 35 of an adjustable strap 36. The strap 36 extends downwardly and is looped around a raised end 38 of a retaining bracket 40 having laterally extending legs 42, 44 which engage the rear panel 26. The raised end 38 projects through a slot 46 formed in the upper end of rear panel 26. The strap 36 proceeds upwardly from raised end 38 of bracket 40 and is threaded through a plastic buckle 48 attached to the looped end 35. The hook 32 and strap 36 allow the fender 10 to be mounted on the boat and adjusted upwardly and downwardly as desired.

The interior of the body 18 is molded with several protrusions 50, as well as with an upper angled wall 52 and a lower angled wall 54. Foam 56 is filled in the voids around protrusions 50 and among the front face 20, the rear panel 26, the sidewalls 22, 24, and walls 52, 54. Molding holes 58 visible from the rear panel 26 indicate the location of the protrusions 50. The molding process also provides an elongated pocket 60 recessed in the rear panel 26. In the preferred embodiment, eight sets of molded receiver grooves 62 extend laterally from opposite sides of the channel 60. Each set of receiver grooves 62 is capable of frictionally retaining a removable lower fastening hook structure 64 used to adjustably connect the body 18 to the lower horizontal support member 16 of the boat 12.

As seen in FIGS. 2–5, the lower fastening hook structure includes a horizontal shaft 66 frictionally and rotatably received in any set of receiver grooves 62. In the drawings, the shaft 66 is shown rotatably disposed in the sixth set of grooves 62. A plastic, U-shaped lower hook 68 is integrally formed with the shaft 62 and includes an inner leg 70 engaged with the body 18 and integrally formed with a base 72 having a series of adjacently disposed channels 74. An outer leg 76 shorter than inner leg 70 provided in the form of a removable tab is slidably and frictionally inserted in one of the channels 74 of base 72. It should be appreciated that the tab 76 may be positioned in any one of the channels 74 as desired to vary the spacing between the legs 70, 76 depending on the depth or thickness of the lower horizontal support member 16 of the particular pontoon boat 12. An elastic retainer cord 78 has one end secured by a retainer 80 to a wall 81 of channel 60, and the other end joined to the back of the inner leg 70 to prevent loss of the removable, adjustable lower fastening hook structure 64.

The rear panel 26 is provided with a pair of spaced apart, Velcro strips 82 for retaining a protective foam block structure 86 provided on its rear face with cooperating Velcro strips 86 that mate with the strips 82.

Figure 5:
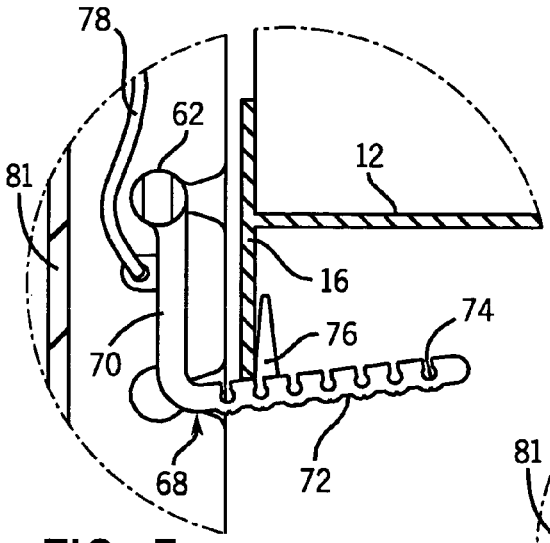
FIG. 5 is a view similar to FIG. 4 with an adjustment made for a smaller rail.
Figure 4:
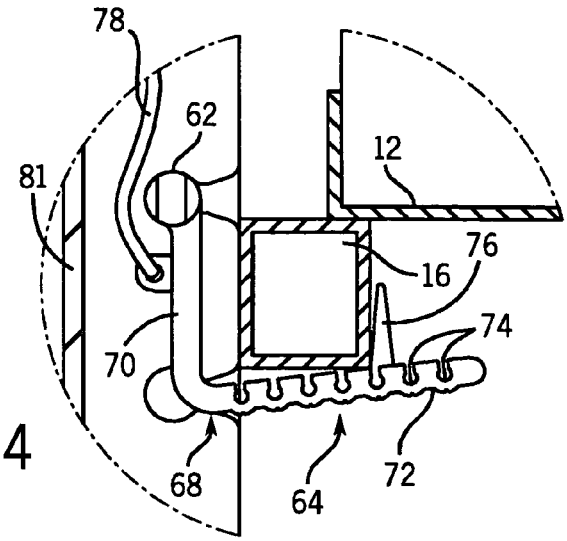
FIG. 4 is a side cross-sectional view taken on line 4—4 of FIG. 2.

As shown in the drawings, the protective fender 10 is installed so that the lower hook 68 engages horizontal support member 16 such as a lower rail outside the side panel 17 of pontoon boat 12 or the floor molding of the boat 12. In the installation of FIG. 4, the tab 76 is adjustably located at a desired channel 74 so as to accommodate the rectangular cross section of the lower rail 16. In FIG. 5, the tab 76 is adjustably located closer to inner leg 70 so as to accommodate the different structure of a thinner rail 16'. The vertical position of the lower fastening hook structure 64 in the appropriate receiver grooves 62 is set so that the top end of the body 18 is in contact with the upper rail or horizontal support member 14. The foam block structure 80 offers additional protection and is adjustably positioned so that it lies centered upon any one or more horizontal support members lying between the upper and lower support members 14, 16. Alternatively, the foam block structure 80 may lie directly against the side panel 17 of the pontoon boat 12. The upper hook 32 is then engaged with the upper horizontal support member 14, such as an upper rail or, in the absence of a rail, the top of the side panel 17 of the boat 12. The upper hook 32 is preferably coated with PVC to protect the upper support member 14. Once the hooks 32 and 68 are engaged with respective upper and lower horizontal support members 14 and 16, the strap 38 is pulled so as to tighten the fender 10 into tight engagement with the boat 12.

In FIG. 2, the example shown illustrates the fender 10 positioned so that the bottom of the fender 10 extends beneath the boat deck and protects the pontoon 88 as well as the majority of the side panel 17 of the boat 12. However, it should be fully appreciated that the fender 10 may be adjustably positioned high or low along the side panel 17 of a pontoon boat 12 depending upon the particular support structure of the boat 12.

The present invention thus provides a specially designed protective fender 10 for a pontoon boat 12 and features a dual hook attachment system which allows the fender 10 to be protectively positioned and retained at any height desired. The fender 10 can be positioned to protect the rail system, the pontoons or both. Unlike prior art designs, the dual hook system prevents the fender 10 from popping up and flying around. The fender 10 is particularly useful in protecting below the water line and does not float up as current fenders typically do. The fender 10 is a complete self-contained system that requires no additional attachment devices or rope so that there is no extraneous structure to catch on docks or other boats. There are no straps which need to be woven through or around rails. The upper hook 32 of the fender 10 is thinly shaped so that it can be conveniently attached between cushion upholstery and the upper rail without damaging the upholstery. Although not shown, stops are available for use on lower support members 16 or rub rails to prevent the fender 10 from slipping or sliding thereon. Pontoon boat covers generally snap directly over the fender 10 or between the rail and the fender 10 so that the fender 10 does not have to be removed when docking.

While the invention has been described with reference to a preferred embodiment, those skilled in the art will appreciate that certain substitutions, alterations and omissions may be made without departing from the spirit thereof. Accordingly, the foregoing description is meant to be exemplary only and should not be deemed limitative on the scope of the invention set forth with the following claims.

I claim:

1. A protective fender for use on a pontoon boat of the type having at least an upper support member and a lower support member, the fender comprising:

an elongated body formed from protective material;

a first fastening means connected to the body and engageable with the lower support member and moveable between a plurality of positions along a length of the body; and a second fastening means connected to the body and engageable with the upper support member and adjustable to vary the position of the second fastening means relative to the body, wherein the first fastening means comprises a U-shaped member with a first leg engageable with the lower support member and a second leg engageable with the body, and wherein the U-shaped member includes a base portion connecting the first and second legs, and the first leg being releasably engageable with the base portion along a plurality of positions whereby the distance between the first and second legs may be varied.

2. The protective fender of claim 1, wherein the base portion includes a plurality of channels engageable with the first leg.

3. The protective fender of claim 2, wherein the first fastening means includes a horizontal shaft attached to the second leg of the U-shaped member.

4. The protective fender of claim 3, wherein the body includes a front base, a pair of outwardly and rearwardly flaring sidewalls, and a rear panel formed with a series of receiver grooves for frictionally retaining the horizontal shaft therein.

5. The protective fender of claim 4, wherein the rear panel has retainer means for removably attaching a foam block structure thereto between the first fastening means and the second fastening means.

6. The protective fender of claim 1, wherein an elastic retainer cord has one end attached to the body and an opposite end connected to the first fastening means.

7. The protective fender of claim 1, wherein the second fastening means includes a J-shaped member engageable with the upper support member, and an adjustable strap having one end attached to the J-shaped member and another end attached to the body.

8. A protective fender for use on a pontoon boat having at least an upper horizontal support member and a lower horizontal support member, the fender comprising:

an elongated body formed from protective material;

a lower fastening hook structure connected to the body and engageable with the lower horizontal support member and moveable between a plurality of vertically disposed positions along a length of the body, the lower fastening hook structure being a U-shaped member with a first leg engageable with the lower horizontal support member and a second leg engageable with the body wherein the U-shaped member includes a base portion connecting the first and second legs, and the first leg being releasably engageable with the base portion along a plurality of positions whereby the distance between the first and second legs may be varied; and an upper fastening hook structure connected to the body and including a retaining hook engageable with the upper horizontal support member and an adjustable strap having one end attached to the retaining hook and an opposite end secured to the body to vary the position of the retaining hook relative to the body.

* * * * *